United States Patent [19]

Steinman, Jr.

[11] Patent Number: 4,533,904

[45] Date of Patent: Aug. 6, 1985

[54] COMBINATION SMOKE AND BURGLAR ALARM

[76] Inventor: LeRoy F. Steinman, Jr., 516 Harbor Walk Dr., Fort Wayne, Ind. 46819

[21] Appl. No.: 584,117

[22] Filed: Feb. 27, 1984

[51] Int. Cl.[3] ..... G08B 19/00; G08B 13/08

[52] U.S. Cl. ..... 340/521; 340/514; 340/546; 340/548; 340/628; 200/61.03; 200/61.76; 200/61.81; 116/5

[58] Field of Search ..... 340/521, 514, 541, 545, 340/546, 548, 586, 590, 628; 200/61.03, 61.08, 61.18, 61.74, 61.76, 61.81, 61.93; 116/DIG. 44, 6, 5, 75, 77, 81, 85–88, 214

[56] References Cited

U.S. PATENT DOCUMENTS

| | | | |
|---|---|---|---|
| 1,562,574 | 11/1925 | Maud | 340/548 |
| 2,086,405 | 7/1937 | Darden | 340/548 |
| 3,175,207 | 3/1965 | Hewitt, Jr. | 340/548 |
| 3,653,022 | 3/1972 | Tall | 340/545 |
| 3,968,483 | 7/1976 | Jolley | 340/546 |
| 4,205,305 | 5/1980 | Nakada | 340/548 |
| 4,258,359 | 4/1981 | McLamb | 340/546 |
| 4,264,892 | 4/1981 | Zonn | 340/521 |
| 4,321,591 | 3/1982 | Vieweg | 340/521 |

FOREIGN PATENT DOCUMENTS 2016777 2/1979 United Kingdom .

*Primary Examiner*—Donnie L. Crosland
*Attorney, Agent, or Firm*—Jeffers, Irish & Hoffman

[57] ABSTRACT

A portable, self-contained combination smoke and burglar alarm includes a smoke sensor and a tester switch both capable of energizing of an audible warning device, all contained in a housing adapted for mounting on an interior room surface such as on a wall or ceiling above a door or window. A releasably inserted locking pin retains a spring-biased plunger mounted above a pressure actuable tester switch accessible externally of the housing to maintain the plunger in its cocked condition. A line attached to the releasable locking pin also attaches to an adjacent door or window such that opening of the door or window increases tension on the line which effectively removes the locking pin and releases the plunger to strike the tester button and actuate the alarm.

19 Claims, 4 Drawing Figures

COMBINATION SMOKE AND BURGLAR ALARM

BACKGROUND OF THE INVENTION

The present invention relates generally to alarms, and in particular to a combination smoke and burglar alarm which is actuated both by the sensing of smoke and by the unauthorized opening of a door or window.

A wide variety of alarms and alarm systems are available for use in homes and businesses, and often the alarm systems are of the combined type wherein both fire and intrusion are detected. In one type of alarm system, magnetic switches, interrupted light beams or infrared detectors indicate an unauthorized intrusion and smoke or heat detectors detect the occurance of a fire. These remote detection devices then transmit signals to a central system which sounds an audible alarm and/or automatically dials the local police or fire department to report the intrusion or fire.

Individual, decentralized burglar alarms are also known, and these alarms are typically mounted at each door or window where intrusion is to be detected and are activated by the opening of the door or window to sound an audible alarm.

Smoke alarms are in widespread use throughout most homes, hotels, restaurants and businesses, and have even been mandated for use in certain establishments, such as hotels, by state legislation. Smoke alarms of this type are well known and generally comprise a housing which is mounted to a wall or ceiling, and contains the battery powered smoke detection circuitry which sounds a horn or the like when a certain level of smoke is detected. In order to enable the user to test the system to ensure that the battery has not run down and that the alarm would be capable of operating when smoke is detected, the smoke alarms are typically provided with a tester button that protrudes through an opening in the housing. The user can depress the tester button against the spring bias of the tester button to activate the circuitry thereby causing the audible alarm to sound. Such tester buttons are typically mounted on the face of the housing, but may also be side mounted.

SUMMARY OF THE INVENTION

The present invention provides for a modification to existing smoke alarms such that the smoke alarms can also function as burglar alarms. This is done by providing means whereby the tester button is depressed upon an unauthorized intrusion, as detected by the opening of a door or window.

The alarm system modified by the present invention retains all of its original features including low cost as well as ease and reliability of operation, but has the additional feature of protecting against unauthorized intrusion.

The modification of the smoke alarm in accordance with one form of the present invention uses a simple plunger-type mechanism easily held in alignment with the existing tester switch external of the housing. When released by removal of a locking pin, the plunger is pressed into engagement with the tester switch with sufficient pressure to sound the alarm. The alarm is set by retracting the plunger, inserting th locking pin, attaching one end of a line to the removable locking pin retaining the plunger in its cocked condition, and by attaching the opposite end of the line to an adjacent closed, but displaceable room-entrance surface, such as a door or a window. Opening of the door or window increases tension on the line which pulls out the locking pin and release the plunger to contact the tester switch and activate the alarm. A simple pulley arrangement can be used to tension the line when connected to a window which opens vertically in a direction toward the alarm.

Typically, smoke alarms are located on the ceiling or on a wall within 1½ feet below the ceiling. Using a typical mounting, therefore, makes it more difficult for an intruder to reach and deactivate the alarm. The tensioned line extending from the alarm mounted above a door or window can easily be concealed from an intruder when the line connects to the movable portion of the door or window. Thus, there is little likelihood that an intruder will deactivate the alarm before opening the door or window.

The owner can easily set the alarm for intrusion detection by using the line attachment to the door or window, and the attachment of the line to the door or window indicates that the alarm is set. In the present invention, the alarm maintains its original smoke detection feature, but the tester mechanism now operates not only to check the energized condition of the alarm, but also to provide protection from unauthorized intrusion.

In one form of the invention, there is provided a combination smoke and burglar alarm for residential and other interiors. The alarm includes a housing to be mounted preferably on a stationary room surface such as a ceiling or on a wall above an adjacent displaceable room-entrance surface such as a door or a window. The housing contains an audible alarm, a smoke detector which activates the audible alarm in response to smoke, and a spring-biased tester switch user pressable externally of the housing for sounding the audible alarm in a test mode. The combination smoke and burglar alarm comprises a plunger mechanism movably supported by a frame assembly mounted externally on the housing and biased by a coil spring in alignment with the tester switch. A locking pin removably inserted into an opening substantially transverse on the plunger compresses the coil spring and holds the plunger mechanism out of engagement with the tester switch. A line having one end portion attached to the removably insertable locking pin and an opposite end attached to an anchor-type locking pin mounted on an adjacent displaceable room-entrance, surface such as a door or a window moving part, trips the biased plunger mechanism to activate the alarm upon the opening of the adjacent displaceable room-entrance surface.

The invention in one form thereof comprises a combination smoke and burglar alarm including a smoke alarm having a housing which contains an audible alarm, and means for sounding the audible alarm in response to smoke. The alarm includes a test system having a spring-biased tester switch actuable externally of the housing by a user, and means controlled by the tester switch for sounding the audible alarm when the tester switch is actuated against its spring bias. This smoke and burglar alarm comprises a tester-switch actuator mounted externally on the housing, and means for biasing the tester-switch actuator into engagement with the tester switch to actuate the switch against its spring bias to sound the audible alarm. A selectively releasable means holds the tester-switch actuator out of engagement with the tester switch against the bias and a trip device connects to the releasable holding means for releasing the tester-switch actuator into engagement with the tester switch when the door or window is opened.

The invention in another from thereof contemplates a combination smoke and burglar alarm mounted on one of adjacent interior room surfaces, one of the surfaces being stationary and the other being a displaceable room-entrance surface such as a door or window. The alarm comprises a housing mounted on one of the surfaces and contains a device for sounding an audible alarm in response to smoke and a test system for sounding the alarm. The test system includes a tester switch with a surface pressable externally of the housing. A biased tester-switch actuator connected to the housing engages the user pressable surface on the tester switch for sounding the alarm in response to undesired intrusion. A selectively releasable holding device holds the tester-switch actuator means out of engagement with the tester switch against the bias and a trip device connects the holding device to the other of the adjacent room surfaces for releasing the tester-switch actuator to engage the tester switch pressable surface and activate the alarm in response to the undesired opening of the door or window.

The invention in accordance with one form thereof contemplates a combination smoke and burglar alarm in a housing mounted on one of adjacent interior stationary and displaceable room-entrance surfaces. The housing contains a smoke actuable device which sounds an audible alarm in response to smoke, and a spring-biased tester switch for testing the audible alarm. The tester switch has a surface user pressable externally of the housing, and controls a switch for sounding the alarm when the tester switch is actuated against its spring bias. A frame assembly mounted externally on the housing movably supports a hammer mechanism for engaging the user pressable surface of the tester switch. The hammer mechanism, such as a spring biased plunger, is biased into engagement with the user pressable surface of the tester switch to actuate the switch against the spring bias for sounding the audible alarm. A selectively releasable holding device connected to the hammer mechanism holds the hammer mechanism out of engagement with the tester switch. A flexible line has one portion attached to the releasable holding device and an opposite portion secured with tension to the other adjacent interior room surface to trip the holding device in response to increased tension on the line caused by the opening movement of the displaceable room-entrance surface. Tripping the holding devices releases the hammer mechanism to engage the tester switch and activate the alarm.

It is an object of the present invention to provide a combination smoke and burglar alarm system of uncomplicated design.

Another object of the present invention is to provide a combination smoke and burglar alarm system that is easily installed by the user.

Yet another object of the present invention is to provide a burglar alarm system that can be easily and inexpensively incorporated into existing smoke alarms Still another object of the present invention is to provide a combination smoke and burglar alarm system that is reliable in operation.

The above-mentioned and other features and objects of this invention and the manner of attaining them will become more apparent, and the invention itself will be best understood by reference to the following description of an embodiment of the invention taken in conjunction with the accompanying drawings.

A BRIEF DESCRIPTION OF THE DRAWINGS

DESCRIPTION OF THE PREFERRED EMBODIMENT

Figure 1:
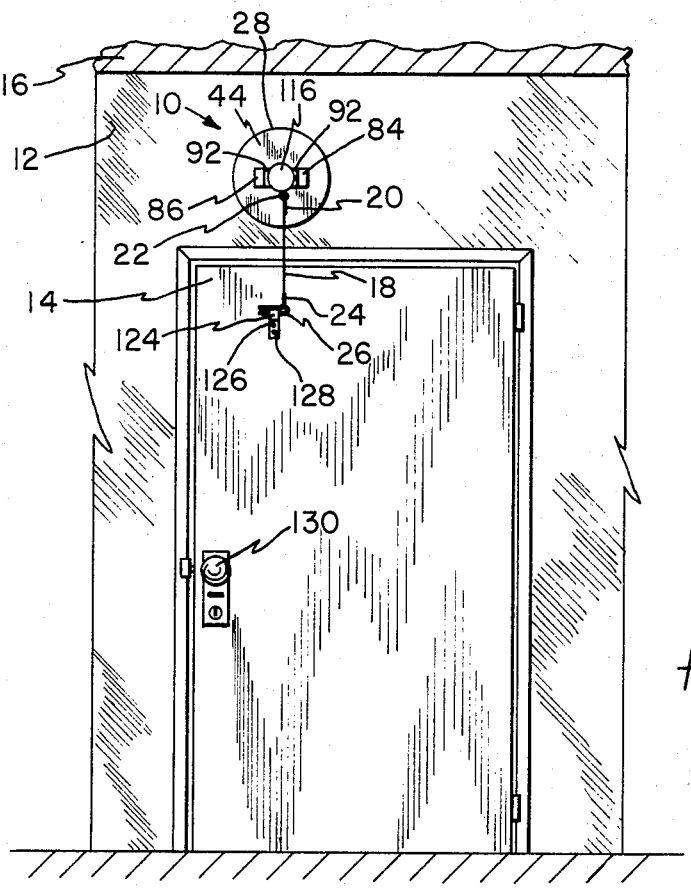
FIG. 1 is a front elevational view of a door and interior wall having the alarm according to a preferred embodiment of the invention mounted thereon.

Referring now to the drawings and particularly to FIG. 1 thereof, alarm 10 is shown mounted on stationary wall surface 12 between the top of door 14 and ceiling 16. A trip mechanism includes a connecting line 18 such as a monofilament line or cable, having one end 20 attached to locking pin 22 on alarm 10, and opposite end 24 attached to anchor pin 26 selectively mounted on door 14. Alarm 10 includes a smoke alarm 27 which may be any one of several conventional readily available smoke/fire alarm units having a tester mechanism with a tester button 40 having a surface 48 adapted to be pressed by the user and accessible externally of the housing to sound the audible alarm. For example, smoke alarm 27 could be a model 5699 alarm manufactured by Honeywell. Typically, such smoke/fire alarms 27 are mounted on a ceiling or on an upper portion of a wall within one and a half feet below the ceiling.

Figure 4:
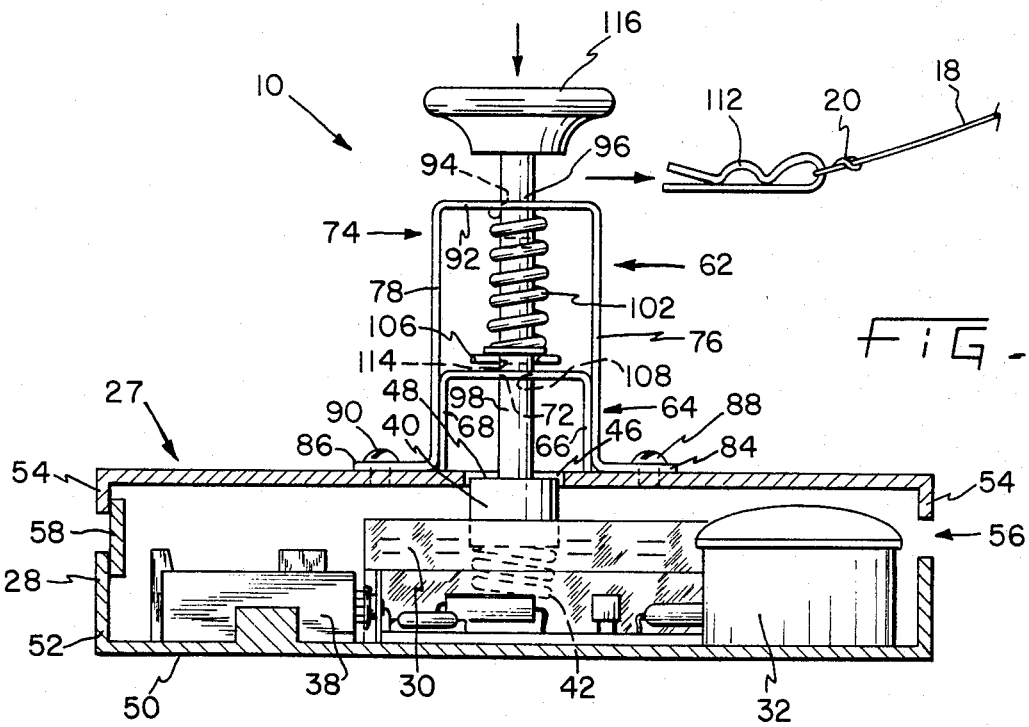
FIG. 4 is an enlarged view similar to FIG. 3 wherein the alarm has been tripped.

The commercially available smoke alarm 27 as seen in FIG. 4 commonly includes a housing 28 containing smoke sensing device 30 which can sense and is responsive to smoke to activate warning means 32 such as an audible horn, bell, siren or the like, and tester switch 40 for checking whether the audible alarm system is operable. As is customary, the smoke detecting device 30 responds to smoke by activating the electrical circuitry to provide a connection between horn 32 and battery 38. Furthermore, the depression of tester button 40 against its biasing spring 42, will cause the circuit to sound horn 32. In the particular smoke alarm 27 shown, the housing 28 has an opening 46 in its upper surface 44 through which tester button 40 protrudes thereby enabling a user to depress button 40 externally of housing 28. Bottom half 50 of housing 28 includes side wall 52 and houses the alarm circuitry.

Figure 3:
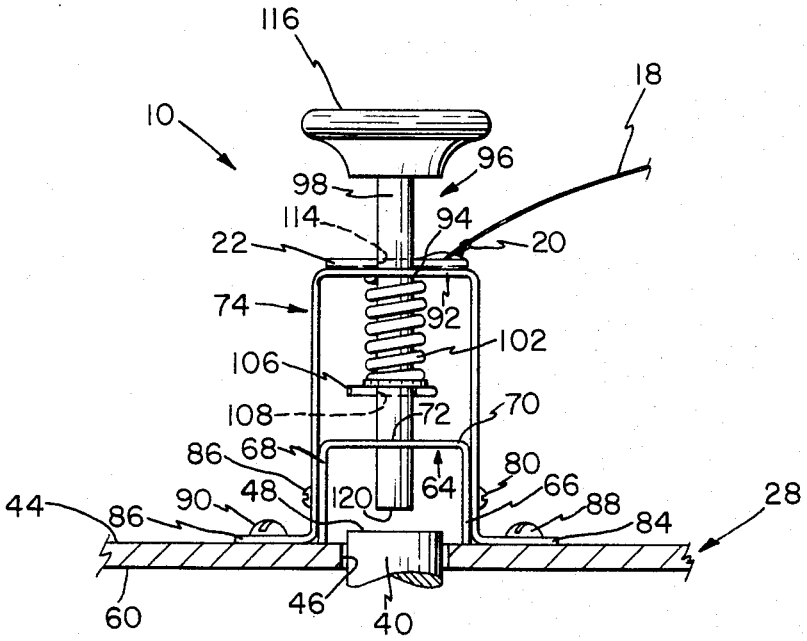
FIG. 3 is an enlarged partially sectioned elevational view of the alarm plunger mechanism in its cocked position.
Figure 2:
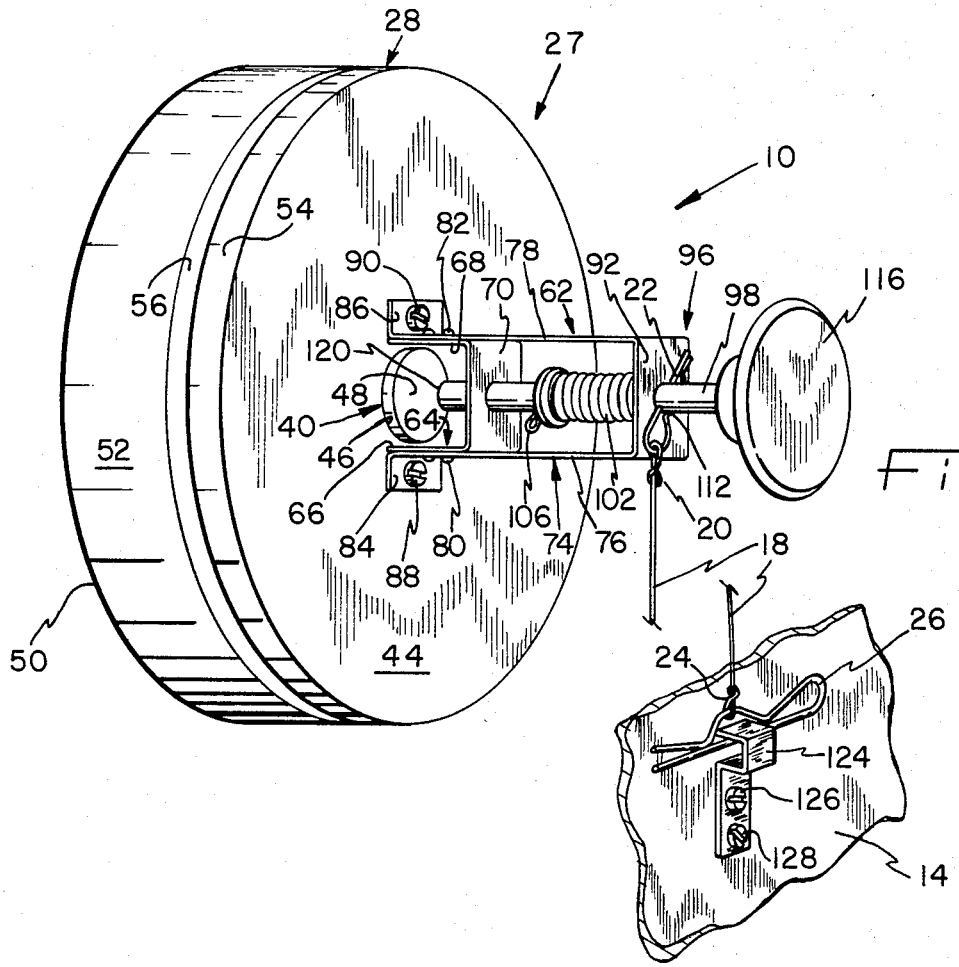
FIG. 2 is an enlarged perspective view of the alarm.

FIGS. 2, 3 and 4 show the modification of smoke alarm 27 to form the combined smoke and burglar alarm 10 according to one form of the present invention so that it also provides protection against intruders. Frame assembly 62 comprises lower inverted U-shaped frame 64 having opposite spaced-apart legs 66 and 68 situated on either side of opening 46 and cross-portion 70 having an opening 72 therein aligned with opening 46. Upper inverted U-shaped frame member 74 is mounted on housing upper surface 44 above frame member 64 and has opposite spaced-apart legs 76 and 78 overlying the outer surfaces of adjacent legs 66 and 68 with leg 76 secured to leg 66 by screws 80 and with leg 78 secured to leg 68 by screws 82. The bottom portions of legs 76 and 78 extend outwardly on surface 44 to form support feet 84 and 86, respectively, which are secured to housing upper surface 44 by respective screws 88 and 90. Cross-portion 92 connects the top ends of legs 76 and 78 and has an opening 94 therein aligned with opening 72 and tester button 40.

A tester switch activator in the form of plunger mechanism 96 comprises rod 98 slidably guided by frame openings 72 and 94. Coil spring 102 circumposed around the mid-portion of plunger rod 98 is maintained in position on rod 98 by washer 105 and lower locking pin 106 inserted substantiallv transversely in opening 108 on rod lower mid-portion. Locking pin 22 is removably inserted substantially transversely through rod 98 in opening 114 above cross-portion 92 to thereby compress coil spring 102 between cross-portion 92 and locking pin 106. Resilient pin 22 may include arcuate portion 112 which captures rod 98 when pin 22 is fully inserted in rod 98. Spring 102 and pin 22 form the releasable bias for plunger 96. Pulling of locking pin 22 from opening 114 by line 18 when the door 14 is opened, releases the compression of coil spring 102 to drive plunger mechanism 96 downwardly in frame assembly 62 until stopped by knob 116 on rod 98 meeting cross-portion 92. Knob 116 can be replaced by any suitable cap such as a an adjustable threaded thumb nut, a crossbar or any device which prevents rod end 118 from descending through opening 92. Openings 72 and 94 in frame 62 guide rod 98 when locking pin 22 is removed from rod opening 108 so that the head 120 of rod 98 strikes tester button 40 with sufficient pressure to energize audible alarm 32.

The opposite end 24 of connecting line 18 attaches to anchor pin 26 held by anchor 124 secured to door 14 by screws 126 and 128. Anchor 124 can be any easily mountable device providing means for inserting or holding anchor pin 26. Alternatively, the end 24 of line 18 can be secured directly to door knob 130 or other suitable available door hardware in lieu of using anchor 124.

In operation, the housing 28 for alarm 10 is mounted in the vicinity of the entrance door 14 or window, preferably at a height where it will operate effectively as a smoke alarm and is sufficiently high so that an intruder will have difficulty in disabling the alarm once it has been activated.

The door 14 or window is closed, plunger rod 98 is retracted and spring 102 is compressed by pulling on knob 116 until opening 114 clears cross portion 92. Locking pin 22 is then inserted into opening 114 and is spread apart until arcuate portion 112 captures rod 98. Knob 116 is then released and plunger 96 will be held in its compressed retracted position by pin 22. Mounting anchor 124 is mounted to the door 14 or window at a distance such that all or nearly all of the slack of line 18 is taken up when pin 26 is inserted in mounting anchor 124. At this point, alarm 10 is set.

Should door 14, or a window (not shown) if alarm 10 is connected to a window, be opened, line 18 will be tensioned thereby pulling locking pin 22 out of the opening 114 in plunger rod 98. This will permit spring 102 to drive rod 98 against the tester button 40, which will close the test circuit within smoke alarm 27 and sound audible alarm 32. To silence the alarm, plunger 96 is again retracted and locked in place by pin 22.

Alarm 10 is capable of being used to detect the unauthorized opening of doors, double hung windows, french windows, and virtually any entrance to a room or building. In the case of a double hung window where alarm 10 is typically mounted above the window and the window opens in a direction towards the alarm, the use of a pulley, such as an eye screw or the like mounted to the window frame may be necessary to tension the line in the proper direction to trip the alarm.

Although the preferred embodiment described shows the alarm mounted on wall 12 with line 18 connecting to door 14, this arrangement can be reversed. The preferred embodiment utilizes a plunger mechanism 96 which moves axially into engagement with the tester button 40, but alternative arrangements are contemplated. For example, a rotatable arm (not shown) could be spring biased to rotate through an arc and strike tester button 40 when the arm is released, as by the removal of a retaining pin or the like. Cotter-type locking pins have been illustrated, and such pins have proven to be effective in holding the plunger mechanism 96 in its cocked position, but other types of trip mechanisms could be used.

While this invention has been described as having a preferred embodiment, it will be understood that it is capable of further modifications. This application is, therefore, intended to cover any variations, uses, or adaptations or the invention following the general principles thereof, and including such departures from the present disclosure as come within known or customary practice in the art to which this invention pertains and fall within the limits of the appended claims.

I claim:

1. A combination smoke and burglar alarm including a housing; a smoke alarm means in said housing including an audible alarm, means in said housing actuable by smoke for activating said audible alarm, and a test system for actuating said audible alarm, said test system including a spring-biased tester switch user actuable externally of said housing, and means for sounding said audible alarm responsive to external activation of said tester switch against said spring bias, said smoke and burglar alarm comprising:

a tester-switch actuator mounted externally on said housing and disposed to effect contact with said tester switch sufficient to activate said audible alarm;

selectively releasable means for biasing said tester-switch actuator to engage said tester switch when released for actuating the tester switch against the spring bias of the tester switch to sound the alarm; and trip means for releasing said means for biasing to bias said tester-switch actuator against said tester switch by an opening movement of a door or window.

2. The alarm of claim 1 wherein said tester-switch actuator means includes a frame mounted on said housing and a movable member supported by said frame; and said means for biasing comprises an actuation spring connected to said frame and to said movable member.

3. The alarm of claim 2 wherein said movable member is a plunger and said frame includes means for guiding said plunger to engage said tester switch.

4. The alarm of claim 2 wherein said movable member is elongate with at least one opening therein, and said bias means comprises a pin means removably inserted in the opening and acting against said frame to hold said movable member out of engagement with said tester switch against the bias of said actuation spring, said trip means includes means for connecting said pin means to a door or window.

5. The alarm of claim 4, wherein said trip means includes a flexible line member attached to said pin means and adapted to be connected also to a door or window.

6. The alarm of claim 2, wherein said bias means includes a selectively releasable holding member for holding said actuation spring compressed.

7. The alarm of claim 6, wherein said trip means includes a connecting means between said holding member and an adjacent displaceable room-entrance surface for displacing the holding member to release the actuation spring by movement of the adjacent displaceable room-entrance surface.

8. The alarm of claim 7, wherein said connecting means is a flexible line member.

9. The alarm of claim 8, wherein said line member has one end portion attached to said selectively releasable holding member compressing said spring, and an opposite end portion attached to said adjacent displaceable room-entrance surface.

10. A combination smoke and burglar alarm including a smoke alarm means having a housing, an audible alarm, means in said housing for sounding said audible alarm in response to detecting smoke, a test system having a spring-biased tester switch actuable externally of said housing by a user, and means controlled by said tester switch for sounding said audible alarm when said tester switch is actuated against its spring bias; said smoke and burglar alarm comprising:

a tester-switch actuator mounted externally on said housing;

means for biasing said tester-switch actuator into engagement with said tester switch to actuate said switch against its spring bias to sound said audible alarm;

selectively releasable means for holding said tester-switch actuator out of engagement with the tester switch against said means for biasing; and trip means connected to said means for holding and adapted to be activated by opening a door or window for releasing said tester-switch actuator into engagement with said tester switch when the door or window is opened.

11. The alarm of claim 10, wherein said tester-switch actuator means includes:

a frame assembly, said assembly having openings therein aligned with said tester switch; and a movable plunger member slidably mounted in said frame openings.

12. The alarm of claim 11, wherein said means for biasing includes a spring compressed on said plunger.

13. The alarm of claim 12, wherein said trip means includes a flexible line connecting said means for holding to a door or window.

14. A combination smoke and burglar alarm mounted on adjacent interior room surfaces, one of said surfaces being stationary and the other surface being a displaceable room-entrance surface such as a door or window, said alarm comprising:

a housing containing a means actuable by smoke for sounding an audible alarm, and a test system including a tester switch for sounding said alarm, said tester switch including a surface pressable external to said housing by a user, said housing being mounted on one of said adjacent interior room surfaces;

tester switch actuator means connected to said housing and biased by a bias means for engaging said user pressable surface on said tester switch for sounding said alarm;

selectively releasable means for holding said tester-switch actuator means out of engagement with said tester switch against said bias means; and means connecting said releasable means to the other of said adjacent interior room surfaces for tripping said releasable means to release said actuator means to engage said tester switch pressable surface to thereby activate said audible alarm upon opening of said displaceable room-entrance surface.

15. The alarm of claim 14, wherein said housing is mounted on said stationary surface adjacent to said displaceable room-entrance surface.

16. The alarm of claim 15, wherein said actuator means includes: a frame having at least one opening in alignment with said tester switch; and a plunger slidably mounted in said frame opening.

17. The alarm of claim 17, wherein said bias means includes: a coil spring circumposed around said plunger; and said releasable means comprises at least one locking pin means selectively inserted into an opening in said plunger for compressing said spring between said plunger and said frame.

18. The alarm of claim 17, wherein said connecting means comprises a line having one end portion attached to said locking pin means compressing said spring and an opposite end portion attached to said other adjacent room surface.

19. In a smoke and burglar alarm mounted on adjacent interior room surfaces, one of said surfaces being stationary and the other surface being a displaceable room-entrance surface, said alarm including: a smoke alarm means having a housing; means in said housing actuable by smoke for sounding an audible alarm; and a test system having a spring-biased tester switch for testing said alarm, said tester switch including a surface pressable externally to said housing by a user and means controlled by said tester switch for sounding said audible alarm when said tester switch is actuated against its spring bias, the improvement comprising:

a frame assembly mounted externally on said housing;

a hammer mechanism having a head for engaging the pressable surface of said tester switch, said hammer mechanism movably mounted in and supported by said frame assembly;

means for biasing said hammer mechanism into engagement with said pressable surface of said tester switch to actuate said switch against said spring bias to sound said audible alarm; and releasable means connected to said hammer mechanism for holding said hammer mechanism out of engagement with said tester switch; and a line means having one end portion attached to one of said releasable means, and having an opposite end portion secured to said other adjacent interior room surface, said line means being tensioned by the movement of said displaceable room-entrance surface to release the hammer mechanism to engage said tester switch and activate said alarm.

* * * * *